United States Patent [19]

Michielli

[11] 4,009,740

[45] Mar. 1, 1977

[54] ICE CREAM DISPENSING MACHINE

[76] Inventor: Joseph Frank Michielli, 11324 E. 36th Ave., Spokane, Wash. 99206

[22] Filed: Sept. 26, 1975

[21] Appl. No.: 617,096

[52] U.S. Cl. ..... 141/172; 141/174

[51] Int. Cl.[2] ..... B65B 43/60

[58] Field of Search ..... 141/129–191

[56] References Cited

UNITED STATES PATENTS

| | | | |
|---|---|---|---|
| 2,872,952 | 2/1959 | Kreissler et al. | 141/174 |
| 3,299,914 | 1/1967 | Harmon | 141/174 |
| 3,618,642 | 11/1971 | Beaullen | 141/174 |

*Primary Examiner*—Houston S. Bell, Jr.
*Attorney, Agent, or Firm*—Wells, St. John & Roberts

[57] ABSTRACT

An automatic ice cream cone dispensing machine includes an automatic delivery apparatus for taking individual cones one at a time from an upright nested stack, moving the cone translationally to a fill position lateral of the stack, and finally moving the filled cone back to a pick up station. Escapement and cone receiving mechanisms operate to remove successive cones from the stack. The escapement mechanism is operated to open, in response to appropriate positioning of the receiving mechanism, allowing the stack of cones to fall freely toward the receiving mechanism. The receiving mechanism catches and supports the falling stack by the bottom cone. The escapement then closes to support the remainder of the stack above the bottom container as the receiving mechanism is lowered to move the bottom cone free of the stack. The container and receiving mechanism is then moved by a transfer mechanism to the fill and pick up stations. A filling mechanism is provided to fill the individual cone at the filling position in conjunction with operation of the delivery apparatus.

11 Claims, 13 Drawing Figures

FIG 1
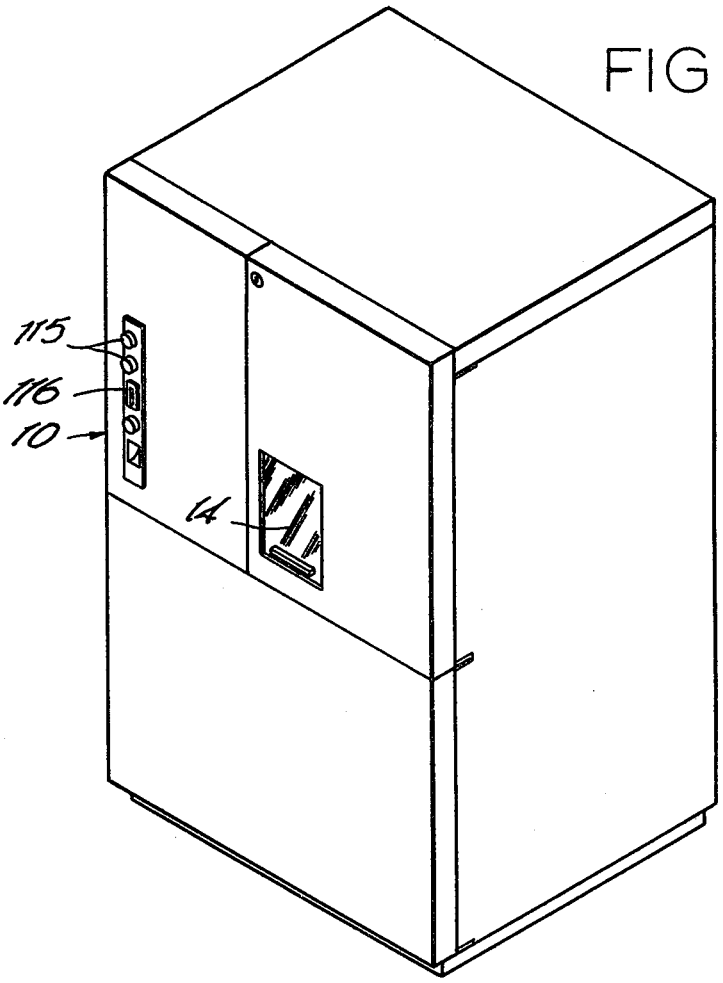
FIG 3
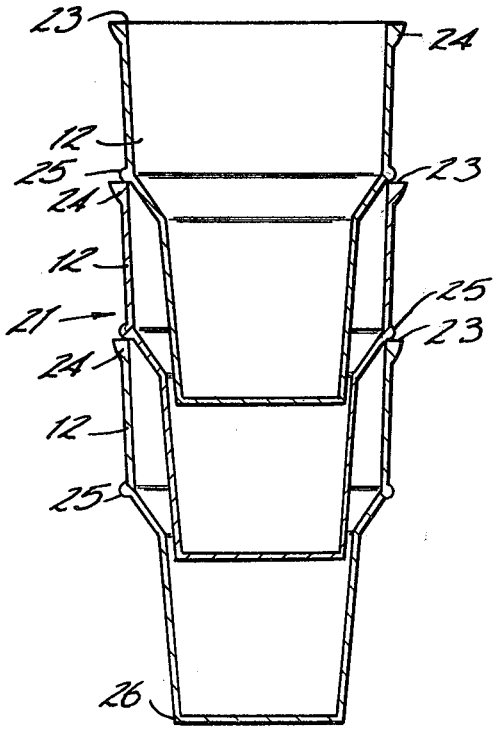
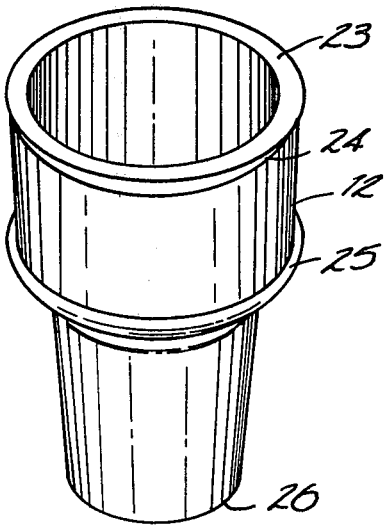
FIG 2

FIG 8
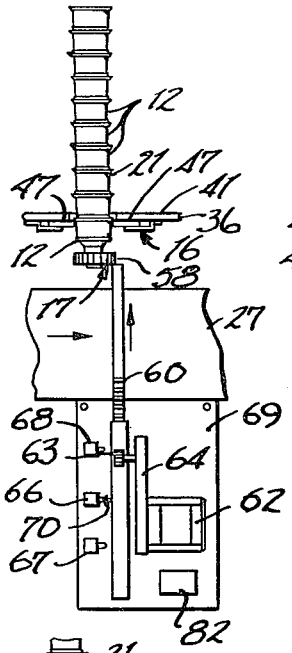
FIG 9
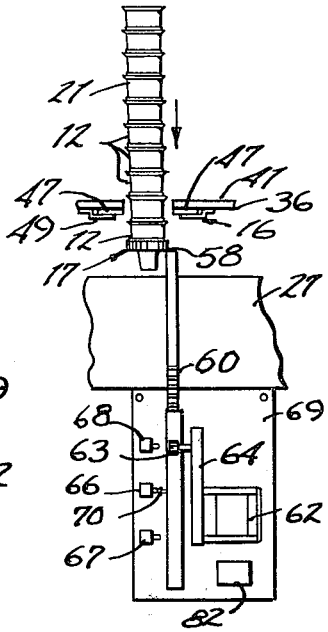
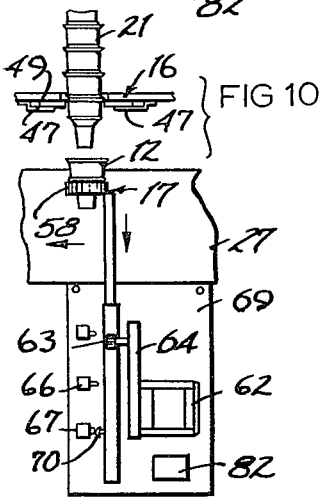
FIG 10
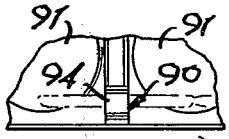
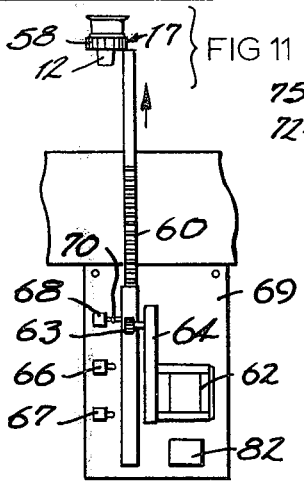
FIG 11
FIG 12
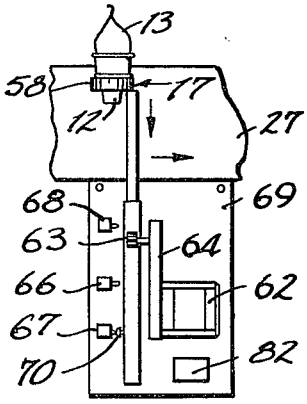
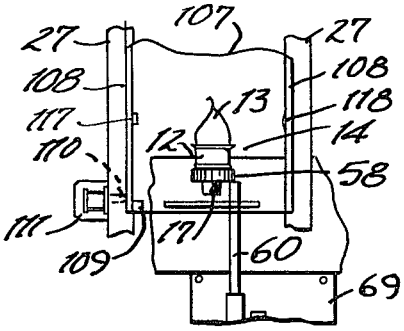
FIG 13
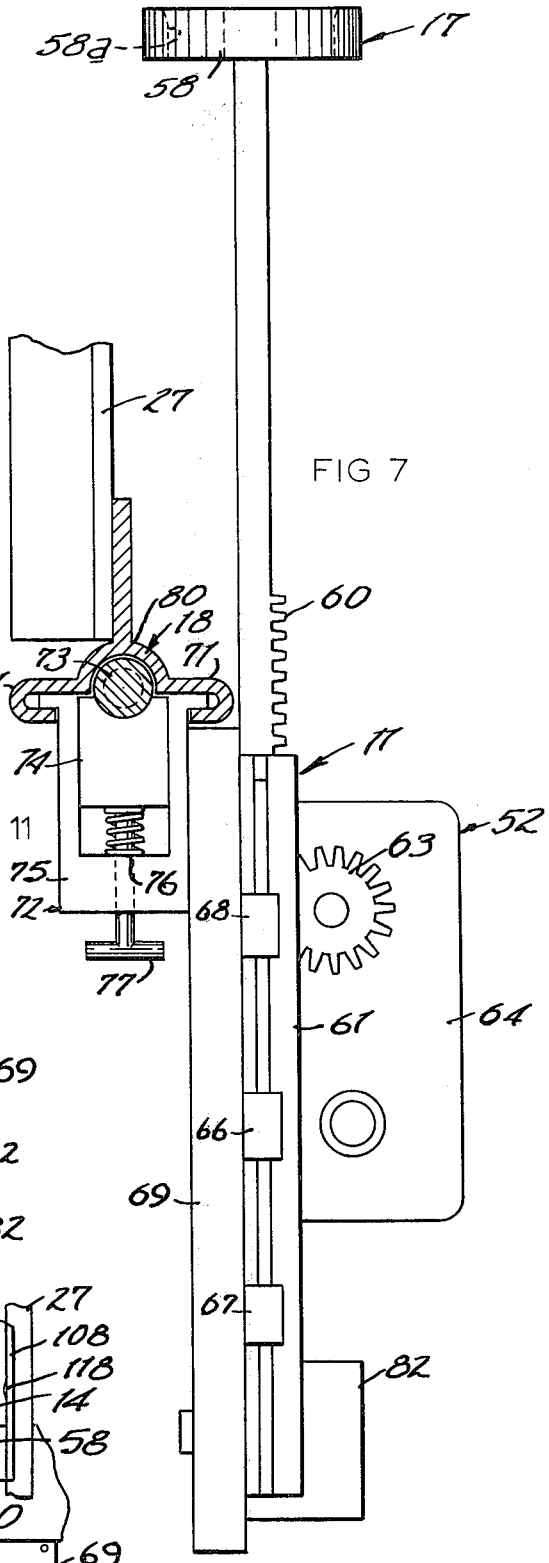
FIG 7

ICE CREAM DISPENSING MACHINE

BACKGROUND OF THE INVENTION

The present invention is related to automatic ice cream cone dispensing machines.

Vending machines have been popularly utilized for the purpose of vending ice cream. However, because of the ease in handling, the ice cream is usually first preprocessed into a bar configuration, sandwich shape, or other appropriate pre-molded configuration whereby the only step required of the vending machine is the delivery of the article to the access door. The popularity of soft ice cream cones (a measured amount of soft ice cream held within a usually edible cone) has brought about a need for providing a suitable vending machine for such articles.

A machine for drawing, filling with an ice cream bulk material and automatically distriubuting a cone is disclosed in U.S. Pat. No. 3,478,702. This machine includes a stationary guide on which a slide is movably connected. The slide extends laterally between a magazine holding a plurality of upwardly open ice cream cones and a pick up station whereat filled cones are received by a purchaser. A gripping member is provided on the slide which is movable thereon to engage the bottom cone of the stack and to pull it downwardly away from the stack. The freed cone is then moved in a prescribed path to an ice cream filling station where a measured amount of ice cream is deposited into the cone. Finally, the filled cone is moved further along the path to the pick up station. Receiving, filling, and pick up stations are arranged in order so that the machine presents a substantially wide front. In addition, this apparatus is powered by air pressure directed through a plurality of cylinders and valves. Accuracy in positioning of corresponding members through utilization of air pressure is extremely difficult to obtain. Therefore, such a machine would require frequent maintenance checks.

Another U.S. Pat. No. 2,899,988 to D. L. Stanley discloses an ice cream dispenser that utilizes mechanical mechanisms for dispensing hard ice cream cones. This machine is necessarily very complex to provide a method by which the hard ice cream is scooped from a bulk container and deposited into a single cone or dish.

U.S. Pat. No. 3,587,478 also discloses a dispensing machine that is utilized to distribute single ice cream cones to an access point. The ice cream is held within individual cylindrical containers and is forced into the cones, leaving the empty cylindrical containers to be further processed.

It is one object of the present invention to provide a new and novel automatic ice cream dispensing machine that is superior to previous machines of this type.

Another object is to provide such a machine that is compact in configuration with a cone magazine and filling station straddling a cone pick up station. The cones will move from the magazine, past the pick up station to the filling station and, subsequently, back to the pick up station after receiving a measured amount of ice cream.

A still further object is to provide an escapement mechanism for nested cones that is effective in releasing single cones to a receiving mechanism without requiring that each cone be grasped and forceably pulled from the stack to minimize breakage of fragile cones.

A still further object is to provide such a machine that is relatively simple in construction and is therefore easy to maintain.

These and still further objects and advantages will become apparent upon reading the following description, which taken with the accompanying drawings, disclose a preferred form of the present invention. It should be noted however that the description and drawings represent only a preferred form of the invention and that other forms may be readily devised by those skilled in the art. For this reason, only the claims provided at the end of this desclosure are to be taken as definitions of my invention.

BRIEF DESCRIPTION OF THE DRAWINGS

A preferred form of the present invention is illustrated in the accompanying drawings in which:

FIG. 1 is a pictorial view of the present machine;

FIG. 2 is a pictorial view of a single cone;

FIG. 3 is a vertical section through a nested stack of cones such as that shown in FIG. 2;

FIG. 7 is an enlarged sectional view of a cone receiving mechanism as taken along line 7—7 in FIG. 4;

FIG. 8 is an operational view showing the cone receiving mechanism in a first elevation for receiving successive cones from the escapement mechanism;

FIG. 9 is an operational view similar to FIG. 8 only showing the stack of cones in a released position with the bottom cone being supported by the receiving means;

FIG. 10 is another operational view showing the bottom cone being removed from the remainder of the stack;

FIG. 11 is another operational view showing a cone in position below an ice cream dispensing mechanism;

FIG. 12 is another operational view showing a filled cone being lowered to a transfer position; and FIG. 13 is another operational view showing a filled cone at a pick up position.

DETAILED DESCRIPTION OF A PREFERRED EMBODIMENT

Figure 4:
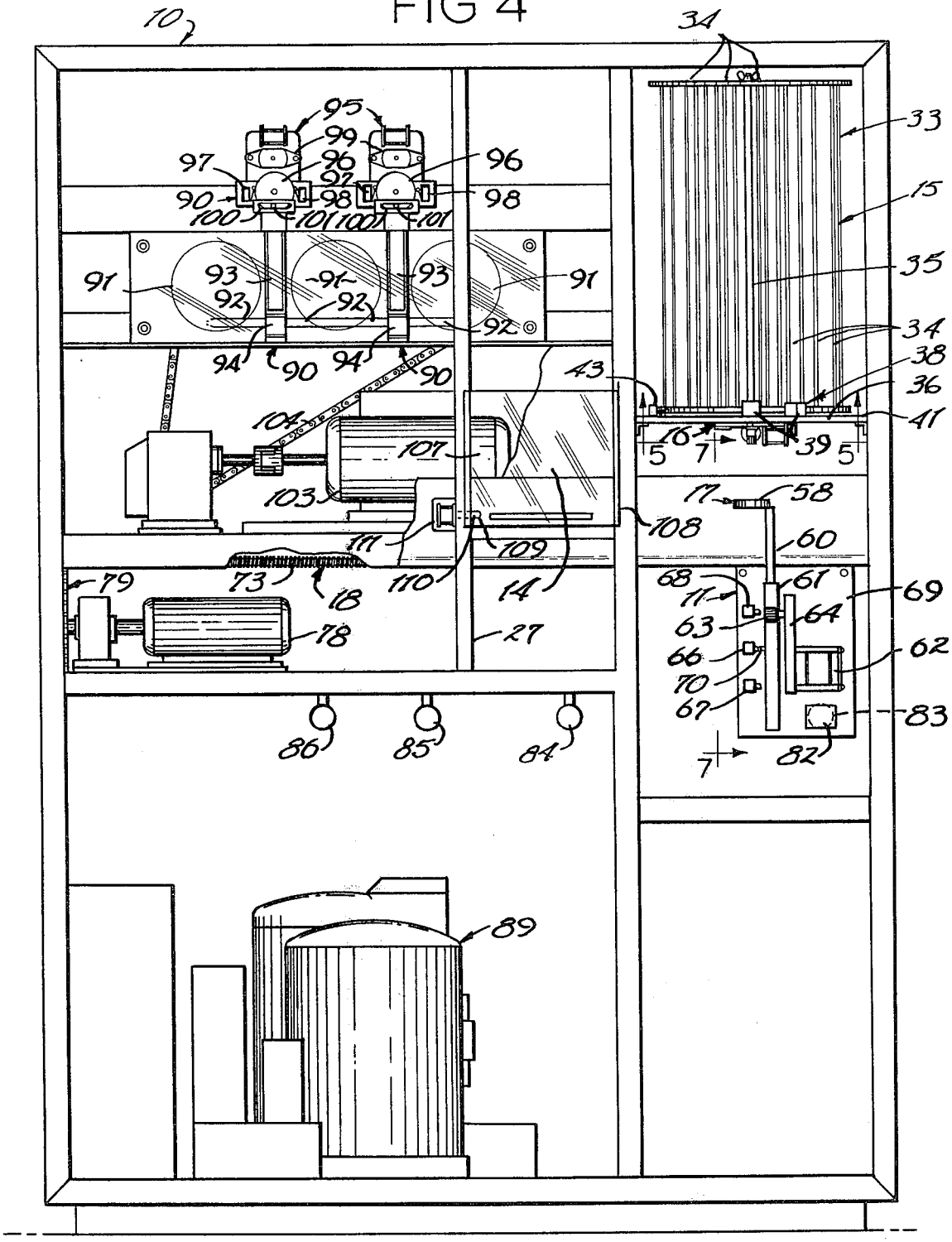
FIG. 4 is a frontal enlarged view of the machine shown with cover panels removed.

FIGS. 1 and 4 show an ice cream dispensing machine embodying a preferred form of the present invention that is generally designated by the reference numeral 10. Machine 10 includes a cone delivery apparatus 11 that is utilized to receive individual cones 12, fill them with ice cream 13 (FIGS. 12 and 13) and deliver the filled cones to a pre-selected filled cone discharge station 14. The cones are initially held in upright nested stacks 21 within a magazine 15 at an empty cone dispensing station as shown in FIG. 4. An escapement mechanism 16 and a cooperating receiving means 17 function to remove cones one at a time from upright stacks 21. A transfer means 18 is also provided to move the receiving means and a cone held thereby laterally from the empty cone dispensing station sequentially to an ice cream filling station and, then, to the discharge station 14.

Fragile ice cream cones are shown in substantial detail by FIGS. 2 and 3. Cones 12 are conventional edible fragile ice cream cones that are specifically designed to be held in loosely nested upright stacks 21. Each cone 12 includes an upwardly open end 23 defined by an upper lip 24. A substantially cylindrical portion of the cone extends downwardly from lip 24 to a lower flange 25. The cone 12 then converges downwardly to a reduced closed end 26. The particular configuration of cones 12 enable them to be loosely stacked in upright condition with the open ends 23 facing upwardly. When stacked, as shown in FIG. 3, the adjacent cones are nested together with their flanges 25 resting on lips 24 of the cone directly below. It is important to note that the cones are not wedged together in any manner. Rather, each cone is held within the stack by gravity, and therefore the bottom cone will fall free of the stack if not otherwise supported.

Figure 5:
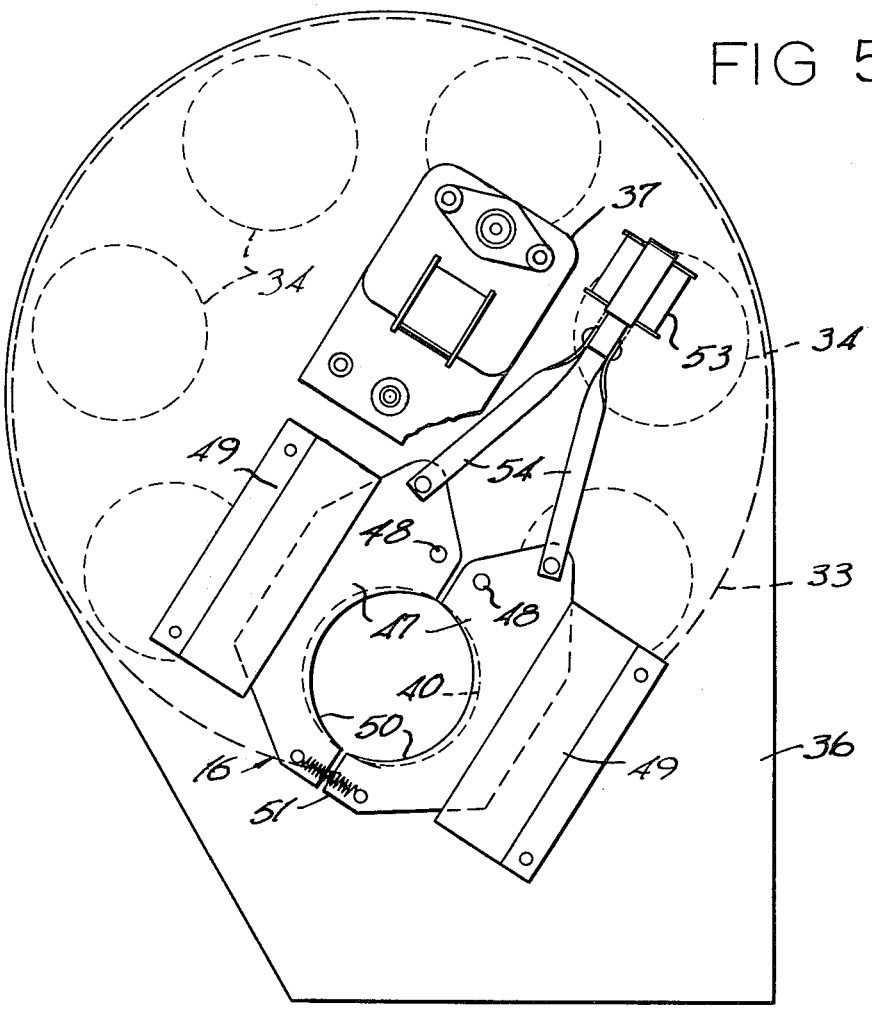
FIG. 5 is a bottom plan view of an escapement mechanism as taken along line 5—5 in FIG. 4.

Several stacks 21 of cones are held within a supporting framework 27 by a rotatable carousel 33. Carousel 33 includes a plurality of vertical open chutes 34 that are equiangularly spaced about a central turn-table shaft 35 (FIG. 5, dashed lines). The carousel is rotatably carried on a magazine base 36. Carousel 33 is rotated through means of a drive motor 37 as may be seen in FIG. 5. This motor is operated in response to a control means 38 that automatically determines the presence of a stack 21 of containers 12 over a circular opening 40 within the base 36. Two photo cells 39 and a limit switch 43 may be utilized for this purpose to automatically provide stacks of cones at opening 40 and to assure that the machine will not operate when the magazine is empty.

Opening 40 (FIGS. 5 and 6) is substantially larger in diameter than the diameter of the containers within the stack above. As shown, opening 40 is situated, relative to the shaft 35, such that only one column or stack 21 of cones 12 may be aligned with the opening at one time. The remaining stacks of cones 12 are slidably supported along an upper planar surface 41 of the magazine base 36. As the carousel rotates, the bottom cones 12 slide across base surface 41 until they come into alignment with opening 40. At this point, the stack falls freely through opening 40 until the bottom cone 12 is received and supported by the escapement means 16 (FIG. 8). Escapement means 16 is located on the under side of magazine base 36 so that the stacks are received after falling the shortest possible distance through opening 40.

Figure 6:
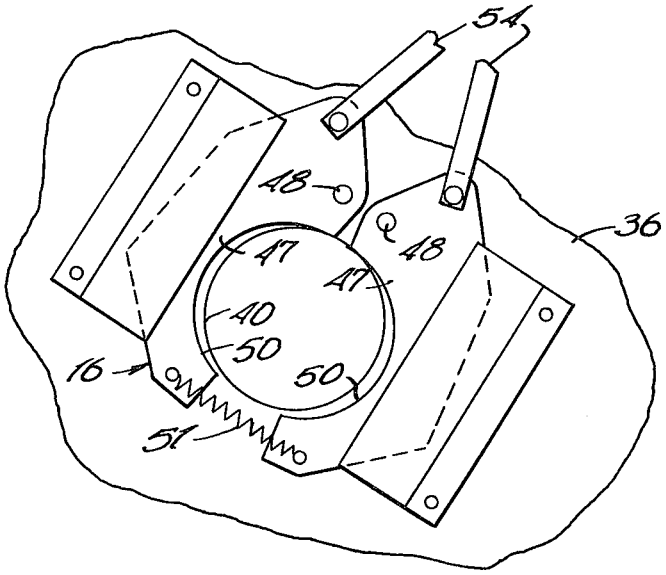
FIG. 6 is a fragmentary view showing an alternate position of the elements comprising the escapement mechanism as shown in FIG. 5.

The escapement means 16 is operative to alternately support and release a stack 21 so it is incremently dropped downwardly through opening 40. This is accomplished by a pair of aperture plates 47 (FIGS. 5 and 6). Plates 47 are pivotably mounted to magazine base 36 about parallel vertical axes of pivot pins 48.

Plates 47 are slidably held for movement within a horizontal plane by a pair of guide plates 49.

Each aperture plate 47 includes a concave surface 50. These surfaces are complementary to a portion of opening 40 so that when they are closed together (FIG. 5) a portion of opening 40 is overlapped to produce another opening that is substantially smaller in diameter than the corresponding diameters across the cone lips 24 (maximum transverse dimension of the cones). Therefore, the bottom cone of the stack is received and the entire stack supported by aperture plates 47 when the aperture plates 47 are in a closed position.

Outer ends of aperture paltes 47 are biased toward one another through means of a spring 51 mounted therebetween. The plates are pivoted against opposition by spring 51 to an open position by means of a solenoid 53 that is connected by strips 54 to plates 47. Activation of solenoid 53 serves to pivot the aperture plates apart, moving concave surfaces 50 outwardly away from opening 40 as shown in FIG. 6. This enables free gravitational movement of the cone stack through opening 40. Inherent vibration of the solenoid (when operating) enhances separation of the cones within the stacks should two or more cones become bound together due to moisture within the stack.

The fall of the cone stack is halted as the bottom cone is received by receiving means 17. The receiving means 17 is shown in substantial detail on FIGS. 4 and more particularly in FIG. 7. Receiving means 17 includes an annular cone receiving or ring member 58 that is positionable directly below the opening 40 as may be seen in FIGS. 4 and 8 to receive the stack of cones when the plates 47 are open. The stack drops with the bottom cone engaging and resting in annular receiving member 58. The cone immediately above the bottom cone is then elevationally positioned in the escapement mechanism between the plates 47. Each time, the stack is allowed to drop a distance equal to or slightly less then the distance between the upper lip 24 and lower flange 25. With the cone stack in this position, solenoid 53 is deactivated to allow spring 51 to retract aperture plates 47 about the second cone.

Ring member 58 includes a central opening 58a (FIG. 7) that is smooth walled and sufficiently large to loosely receive the closed lower end 26 of a cone 12. Member 58 receives the stack by its bottom cone as it falls gravitationally when released by escapement means 16. It should be noted that the bottom cone is held in ring 58 only by its own weight and the weight of the stack above.

The receiving means 17 includes a drive means 52 that is operable to lower the released bottom cone from the stack and to facilitate filling such cones with ice cream. Drive means 52 is partially comprised of an upright rack 60 that mounts ring member 58 at an upward end thereof. The gear rack 60 is slidably held within an open housing 61. A motor 62 and pinion 63 cooperate through an opening in housing 61 to engage and move the rack 60 vertically. A gear box 64 is present between motor 62 and pinion 63 in order to control vertical speed of the receiving member 58.

Three switches 66, 67 and 68 located adjacent to the gear rack 60 on a mounting base 69. A cam 70 is positioned along the rack 60 to engage and successively operate switches 66, 67 and 68 as rack 60 moves vertically. Switches 66 through 68 function in part to control operation of motor 62 to stop vertical movement of receiving member 58 and the cone held thereby at three selected elevational positions. A first elevation is shown in FIGS. 4 and 8 whereat the first switch 66 is engaged to srop receiving member 58 at a cone receiving position. The second position as shown in FIG. 10 whereat the second switch 67 is engaged and operated to stop downward movement of the released cone as it clears the stack 21 and is located at a transfer position. The third switch 68 is located to stop movement of the receiving member 58 at a third elevation in a fill position as shown in FIG. 11. In this position, the member is fully raised to locate the cone held thereby directly below an ice cream discharge (discussed in greater detail below).

Lateral movement of the cones is effected by transfer means 18 when the receiving ring is elevationally located at the transfer position (FIGS. 10, 12 and 13.). Means 18 includes a carriage 72 (FIG. 7). Carriage 72 is reciprocably moved sequentially between the stations by means of a powered lead screw 73 (FIGS. 4 and 7). Also included with means 18 is a vertically movable half nut 74 that is slidably received within a carriage housing 75. The half nut 74 is urged toward engagement with lead screw 73 by a compression spring 76. However, a release bar 77 extends from half nut 74 through an approximate opening in housing 75 to enable selective disengagement of the half nut from lead screw 73 and thereby enable free lateral sliding movement of carriage 72 and receiving means 17 along lateral guide ways 71 that are formed integrally within a lead screw housing 80. Ways 71 and screw 73 guide the receiving means in a lateral path across the width of machine 10.

A motor 78 (FIG. 4) is utilized along with a chain drive linkage 79 to rotate the lead screw 73 about its axis. Motor 78 is reversible so that receiving means 17 may be moved back and forth between the magazine and an ice cream dispensing means 90 (described below). Powered rotation of lead screw 73 is interrupted at selected positions along lateral path of receiving means 17 to stop the cone held thereby. A photo cell 82 is positioned on the carriage 72 in vertical alignment with several laterally spaced corresponding photo cell elements 83 through 86. Each of these elements are stationary and mounted to the machine framework at selected locations to intercept photo cell 82 as it moves laterally with carriage 72. Cell 82 and corresponding elements 83 –86 control motor 78 to stop the carriage at specific stations along its lateral path.

An ice cream dispensing means 90 is illustrated by FIG. 4 of the drawings. In this particular configuration, three bins 91 are utilized, each preferably holding a different flavor ice cream. A refrigeration unit 89 is supplied to cool bins 91. Each bin 91 is connected to a discharge tube 92 that leads toward open communication with one of two common discharge tubes 93. Discharge tubes 93 each include a vertically movable valve 94 that is operated by a valve control means 95.

The stems of valves 94 each include a horizontal slot cam 100. A pin 101 is slidably received within slot cam 100. Pin 101 are fixed to rotatable disc 96. Discs 96 are powered to rotate by a pair of motors 99. The operating time of each motors 99 is controlled by a limit switch 98 operatively connected to the periphery of disc 96 to sense a complete revolution thereof. An additional limit switch 97 is provided to actuate the receiving means 17 to slowly lower the cone as it is being filled with ice cream. Once the disc 96 completes a full revolution, the valve automatically closes and limit switch 98 is operated to deactivate motor 99.

Means is provided to force ice cream through the selected bins 91. This means includes a motor 103 driving a roller chain 104. The chain 104 is operatively connected to augers (not shown) that are rotatably situated within each of the cylindrical bins 91. Upon actuation of motor 103, the selected augers rotate to force ice cream through discharge tubes 92 and into one of the common discharge tubes 93.

It may be noted that there are two separate valves 94 with three bins 91 for three separate ice cream flavors. It is noted however that additional bins could be provided to enable greater numbers of selections or a fewer number of bins (down to one) may be utilized without departing from the scope of my invention.

Provided on the machine framework 27 is an access door 107. This door is located outward of the discharge station 14 (FIGS. 4 and 13). The door 107 is held by vertical guide ways 108 and will slide freely vertically if so allowed by a locking bar 110. Door 107 is normally locked in a closed position by a lug 109 on door 107 engaging locking bar 110. Bar 110 is connected to a solenoid 111 that is mounted to framework 27. The solenoid is actuated to retract, unlocking the access door 107 as a full ice cream cone is moved by transfer means 18 to discharge station 14. When a full cone is in this position, the solenoid retracts lock bar 110 from engagement with lug 109 and enables free vertical movement of the access door 107.

From the above technical description, operation of my invention may now be easily understood. First we assume that magazine 15 is full of stacked cones 12. If this is not the condition, the photo eye 39 adjacent to opening 40 will sense that no cone is in position and activate the motor 35 to begin rotating carousel 33. If no cone is in the next successive chute, the empty condition will be sensed by the second photo cell 39. The machine will then automatically shut down and an appropriate indicator (not shown) will be actuated to inform the operator of the empty condition. However, if there are cones within the next successive chute they will be rotated into alignment with opening 40. Limit switch 43 is provided on the magazine base 36 to stop the carousel as each chute becomes aligned with opening 40.

Now, assuming a stack of cones is in position with the bottom cone thereof supported by the escapement means 16, the condition will appear as schematically illustrated in FIG. 1 — without a cone held in ring 58. This is the location of the carriage at the beginning and end of each operational cycle. The cycle is started in response to a customer making a flavor selection on a control panel 116 (FIG. 1). The receiving ring 58 will then move to a first elevation or cone receiving position (FIG. 8). Switch 66 is operated as receiving ring 58 reaches the receiving position to stop its upward movement and to actuate solenoid 52 to release the stack. As the aperture plates 47 move apart, the full stack drops gravitationally freely through the opening 40 into the awaiting receiving ring member 58. This condition is shown in FIG. 9.

As shown in FIG. 9 the entire stack 21 is supported by receiving means 17 before solenoid 52 means is deactivated to allow plates 47 to close around the cylindrical portion of the second cone from the bottom of the stack. This step is accomplished after a short time delay. As the aperture plates 47 close, the receiving means is simultaneously operated to lower the bottom cone by gravity to a position clear of the stack (FIG. 10). Transfer means 18 is actuated as the second elevation switch 67 is operated to stop further downward progress of receiving ring 58 and cone 12.

The transfer means 18 is operated to move container 12 laterally of the stack past the discharge station 14 to the cone filling station and into alignment with one of the discharge tubes 93. The customer may determine, by pressing an appropriate flavor selector button 115 on a control panel 116, which of the tubes 93 will be used.

Photo cell 82 and a selected corresponding element 85 or 86 is actuated to stop the carriage and to actuate the receiving means to elevate the cone to the filling station at a third elevation (FIG. 11). At this position, the third elevation switch 68 is actuated by cam 70. Switch 68 halts further upward movement of receiving ring 58 and also activates the selected ice cream dispensing means 90. Disc 96 begins to rotate opening valve 94 and limit switch 97. This switch 97 actuates the receiving means to reverse and slowly lower the cone as ice cream flows from the discharge tube 93 into the empty cone. Once the disc makes a complete revolution, second switch 98 is engaged and actuated. This switch 98 shuts off motor 99.

Meanwhile the filled cone reaches the transfer position (FIG. 12) where switch 67 is again operated to halt the downward progress. The transfer means is then activated to reverse and move the filled cone back laterally to the discharge station 14 adjacent access door 107 (FIG. 13). Once the filled container reaches this position, photo cell 82 and corresponding element 84 sense the proper and deactivates lead screw drive motor 78 and activates solenoid 111 to retract the lock bar 110. This unlocks the access door and allows free access to the filled ice cream cone. The customer may then open the access door by sliding it upwardly and gain access to the filled cone located at the pick up position.

A pair of photo cell elements 117 and 18 (FIG. 13) detect when the cone has been removed from the ring holder 58. Elements 117 and 118 then reactivate the transfer means to move the empty receiving ring 58 back to the empty cone dispensing station. Cell 82 and mate 83 stop the carriage at this point and deactivate the receiving means to await the next successive operational cycle. The empty cone receiving member 58 will remain at the second transfer elevation then until an operator again makes a flavor selection. The door 107 will automatically lock once the filled cone has been removed and the door returned to the closed position.

It is again stressed that it is the intention of the above description with reference to the attached drawings to disclose a preferred form of my invention. It is understood, for example, that the escapement means and receiving means could be as easily utilized with containers other than edible ice cream cones. The only requirement is that the containers be substantially identical and able to be stacked with upper open edges spaced apart by a determinable distance. Therefore the following claims are to be taken as restrictions upon the scope of my invention.

What I claim is:

1. In an automatic ice cream dispensing machine a combination comprising:

a supporting framework;

ice cream dispensing means on the framework at an ice cream container filling station for successively dispensing ice cream into ice cream containers;

refrigeration means for cooling the ice cream within the dispensing means;

a container magazine on the framework at an empty container dispensing station for receiving an upright nested stack of upwardly open empty ice cream containers and for guiding the stack to move gravitationally downward through a magazine opening;

carriage means on the framework sequentially movable horizontally between the empty container dispensing station and the container filling station and filled ice cream discharge station intermediate the empty container dispensing station and the container filling station;

an escapement means adjacent the magazine opening at the empty containers dispensing station for alternately (a) closing to support the stack and thereby prevent downward movement of the stack through the magazine opening and (b) opening to release the full stack to fall by gravity with the bottom container of the stack falling below the escapement means; and a container receiving means supported on the carriage and mounted for sequentially (a) moving upward when the carriage is at the empty container station to a first position immediately below the magazine opening to receive the bottom container of the stack when the escapement means is open, (b) supporting the full stack prior to the closing of the escapement means, (c) moving downward after the escapement means is closed to thereby remove the bottom container from the stack, (d) carrying the bottom container on the carriage from the empty container dispensing station to the container filling station, (e) moving this container upward at the container filling station to the ice cream dispensing means, (f) moving the container slowly downward as it is being filled, and (g) carrying the filled container to the container discharge station.

2. In the machine as defined by claim 1 wherein the container receiving means is comprised of:

an upwardly open container receiving member for loosely receiving the bottom container of the stack; and drive means operatively connecting the container receiving member to the carriage for moving the member vertically and horizontally.

3. In the machine as defined by claim 1 wherein the escapement means is comprised of:

a pair of aperture plates mounted to the magazine adjacent the magazine opening for pivotal movement in a horizontal plane between closed and open positions;

oppositely facing concave surfaces on the aperture plates that are spaced apart (a) by a distance less than the maximum cross-sectional dimension of the containers when in the closed position and (b) by a distance greater than the maximum cross-sectional dimension of the containers when in the open position; and means for pivoting the aperture plates between the open and closed positions.

4. In the machine as defined by claim 1 wherein the magazine includes:

a carousel having a plurality of upright stack receiving chutes arranged thereon in a circular pattern about a vertical central rotational axis;

chute drive means for rotating the chutes about the vertical central rotational axis to bring each chute into alignment with the magazine opening; and chute drive control means for operating the drive means to rotate the chutes as one chute presently adjacent the opening becomes empty of containers to bring a chute having a supply of containers therein into alignment with the opening.

5. In the machine as defined in claim 2 wherein the receiving means includes a transfer means comprising:

a horizontal lead screw mounted to the framework extending between the empty container dispensing station, the filled ice cream discharge station and container filling station;

half nut means mounted to the carriage and threadably engaged with the lead screw;

lead screw drive means for automatically operating the lead screw drive means to move the carriage successively between the stations.

6. In the machine as defined by claim 1 wherein the ice cream dispensing means is comprised of:

a plurality of ice cream bins for holding different flavor ice cream;

a delivery tube extending outwardly from selected bins to a common central delivery tube;

a valve within the common central delivery tube;

means for forcing the ice cream through the delivery tube; and valve control means for operating the valve in response to positioning of the receiving means at the ice cream filling position.

7. In an automatic container dispensing machine of the type including a container magazine on a supporting framework at an empty container dispensing station for receiving an upright nested stack of upwardly open containers with upper open container edges spaced equally apart in the stack and for guiding the stack to move gravitationally downward through a magazine opening, an improvement comprising:

an escapement means adjacent the magazine opening for alternately opening and closing to (a) support the stack when closed to prevent downward movement of the stack through the opening, and (b) release the stack when open to fall by gravity with the bottom container of the stack falling below the escapement means; and a container receiving means on the framework for sequentially (a) moving upwardly to a first position immediately below the magazine opening to receive the bottom container of the stack upon opening to the escapement means and thereby support the full stack until the escapement means is again closed, and (b) moving downwardly to move the bottom container after the escapement means is closed.

8. The improvement as defined by claim 7 wherein the container receiving means is comprised of:

an upwardly open container receiving member for loosely receiving the bottom container of the stack; and drive means operatively connecting the container receiving member to the frame for moving the member vertically.

9. The improvement as defined by claim 7 wherein the escapement means is comprised of:

a pair of aperture plates mounted to the magazine adjacent the magazine opening for pivotal movement in a horizontal plane between closed and open positions;

oppositely facing concave surfaces on the aperture plates that are spaced apart (a) by a distance less than the maximum cross-sectional dimension of the stacked containers when in the closed position and (b) by a distance greater than the maximum cross-sectional dimension of the container when in the open position; and means for pivoting the aperture plates between the open and closed positions.

10. The improvement as defined by claim 9 wherein the container receiving means is comprised of:

an upwardly open container receiving member for loosely receiving the bottom container of the stack; and drive means operatively connecting the container receving member to the frame for moving the member vertically.

11. The improvement as defined by claim 10 wherein the containers are each substantially conical in configuration, tapering from an enlarged opening upper end to a reduced closed lower end so when the containers are nested together to form a stack, the open upper ends are spaced apart equally along the central stack axis; and wherein the escapement means is operable to:

a. open to release the stack as the container receiving means moves to a container receiving position spaced below the stack by a distance equal to or less than the distance between the adjacent open upper ends of containers within the stack; and b. close the escapement means once the stack is moved downwardly along the stack axis a distacne equal to or less than the distance between adjacent open upper ends of the containers within the stack.

* * * * *